US006561857B1

(12) United States Patent
Mass

(10) Patent No.: US 6,561,857 B1
(45) Date of Patent: May 13, 2003

(54) HUMP BOAT

(76) Inventor: Romer Mass, 1625 W. 8th St., Davenport, IA (US) 52802

( * ) Notice: Subject to any disclaimer, the term of this patent is extended or adjusted under 35 U.S.C. 154(b) by 0 days.

(21) Appl. No.: 10/014,253

(22) Filed: Nov. 7, 2001

Related U.S. Application Data

(60) Provisional application No. 60/311,617, filed on Aug. 10, 2001.

(51) Int. Cl.[7] ..... B63H 11/00

(52) U.S. Cl. ..... 440/38; 114/56.1; 114/151

(58) Field of Search ..... 440/3, 38, 40, 440/41, 42, 43; 114/56.1, 122, 125, 126, 151, 145 R; 33/374

(56) References Cited

U.S. PATENT DOCUMENTS 855,165 A * 5/1907 Cutter ..... 114/151
1,197,181 A * 9/1916 Buck ..... 114/151
1,413,056 A * 4/1922 Parrish et al. ..... 33/374
3,132,477 A * 5/1964 Egger ..... 114/151
3,590,766 A 7/1971 Jackson
3,675,611 A * 7/1972 Glass ..... 114/151
3,788,263 A 1/1974 McDermott et al.
3,831,543 A * 8/1974 Hamasaki ..... 114/145 R
3,835,806 A * 9/1974 Rice ..... 440/40
3,875,885 A 4/1975 Balquet et al.
3,885,331 A 5/1975 Mathieu
3,893,405 A * 7/1975 Lais et al. ..... 440/40
4,130,943 A * 12/1978 Talbot ..... 33/374
4,411,630 A * 10/1983 Krautkremer et al. ..... 114/151
4,417,877 A * 11/1983 Krautkremer et al. ..... 440/38
4,458,619 A 7/1984 Bergman
4,607,437 A * 8/1986 McSorley et al. ..... 33/374
4,781,141 A 11/1988 Webb et al.
4,813,365 A 3/1989 Lindstrom et al.
4,838,821 A * 6/1989 Krautkremer ..... 114/151
4,896,621 A 1/1990 Coles
4,928,395 A * 5/1990 Good ..... 33/374
4,951,591 A 8/1990 Coles
5,080,032 A 1/1992 Giles
5,129,343 A 7/1992 Giles
5,224,436 A 7/1993 Stricker
5,231,946 A 8/1993 Giles
5,289,793 A * 3/1994 Aker ..... 114/151
5,351,642 A 10/1994 Ackerbloom
5,520,557 A * 5/1996 Kaul et al. ..... 114/151
5,813,357 A * 9/1998 Watson ..... 114/145 R
6,146,219 A * 11/2000 Blanchard ..... 114/151
6,168,481 B1 * 1/2001 Mardikian ..... 114/151

* cited by examiner

*Primary Examiner*—S. Joseph Morano
*Assistant Examiner*—Lars A. Olson
(74) *Attorney, Agent, or Firm*—Sturm & Fix LLP

(57) ABSTRACT

A water vessel containing a central hump or dome underneath the vessel, with a waterjet system pumping water downward into the hump. The invention utilizes waterjet propulsion and hull shape to create water hump lift. A waterjet system pumps water from the front of the vessel downward into the hump underneath the center of the vessel. This produces lift and reduces the water friction against the water vessel. This also creates a wave or hump of water beneath the vessel, enabling the vessel to ride down the resulting wave. The size and shape of the water hump depends on the velocity and angle of the waterjets. Baffles are utilized at the front and sides of the water vessel to direct water away from the vessel, or towards the vessel, as needed to further the efficiency of the system.

10 Claims, 5 Drawing Sheets

HUMP BOAT

CROSS-REFERENCE TO RELATED APPLICATIONS

This application is a continuation of co-pending commonly owned U.S. Provisional Application No. 60-311,617, filed Aug. 10, 2001, entitled Hump Boat. Priority is claimed under 35 U.S.C. §119(e). The contents of the same are expressly incorporated herein by reference.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

1. Field of the Invention

This present invention relates to the field of modified hulls, and more particularly to hulls raised to decrease water resistance.

2. Description of the Related Art

Low-water resistance hulls are well known in the art. Typical low-water resistance hulls are structured to create air pockets beneath a water vessel. Typical low-water resistance hulls do not have a hull that rises toward the stem of said vessel and contains a central groove, in combination with a waterjet propulsion mechanism and front and side baffles for directing water surrounding said vessel.

As can be seen by reference to the following U.S. Pat. Nos. 3,875,885, and 5,231,946, the prior art is replete with planing hulls combined with a propulsion system to lessen water resistance. U.S. Pat. No. 5,231,946, titled "Monohull Fast Sealift Or Simi-Planing Monohull Ship", is an invention designed to plane across the waves, and contains waterjet propulsion jets, but the invention is distinguished from the present invention by the lack of a central groove under the hull in combination with waterjets propulsing water downward. In addition, U.S. Pat. No. 3,875,885 titled "Gas Injection Propulsion System For Marine Vehicles", is also an invention designed to move air beneath the hull, but the invention also lacks a central groove under the hull in combination with waterjets propulsing water downward.

While all of the aforementioned prior art constructions are more than adequate for the basic purpose and function for which they have been specifically designed, they are uniformly deficient with respect to their failure to provide a central groove under the hull in combination with waterjets propulsing water downward.

As a consequence of the foregoing situation, there has existed a longstanding need for a new and improved water vessel utilizing waterjet propulsion and hull shape to create a hump lift whereby the bottom of the vessel's hull rises toward the stem, and the provision of such a construction is a stated objective of the present invention.

BRIEF SUMMARY OF THE INVENTION

Briefly stated, the present invention provides a water vessel utilizing waterjet propulsion and hull shape to create a hump lift whereby the bottom of the vessel's hull rises toward the stern, as will be explained in greater detail further on in the specification. The present invention contains a divided hull with a groove underneath the central portion of the hull. A waterjet system pumps water from the front of the vessel downward into the groove underneath the center of the vessel. This produces lift and reduces the water friction against the water vessel. This also creates a wave or hump of water beneath the vessel, enabling the vessel to ride down the resulting wave. The size and shape of the water hump depends on the velocity and angle of the waterjets.

Baffles are preferably positioned at the front and sides of the water vessel to direct water away from the vessel, or towards the vessel, as needed to further the efficiency of the system. If the pump has insufficient water flow, the front baffles will direct water towards the pump intake area. Conversely, if the pump is receiving too much water volume, the baffles will direct water flow away from the forward pump. The baffles also are preferably used for further reducing the volume of water that the vessel is required to displace in traversing through the water. Bow baffles preferably also help to steer the vessel.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE BEST MODE

Figure 1:
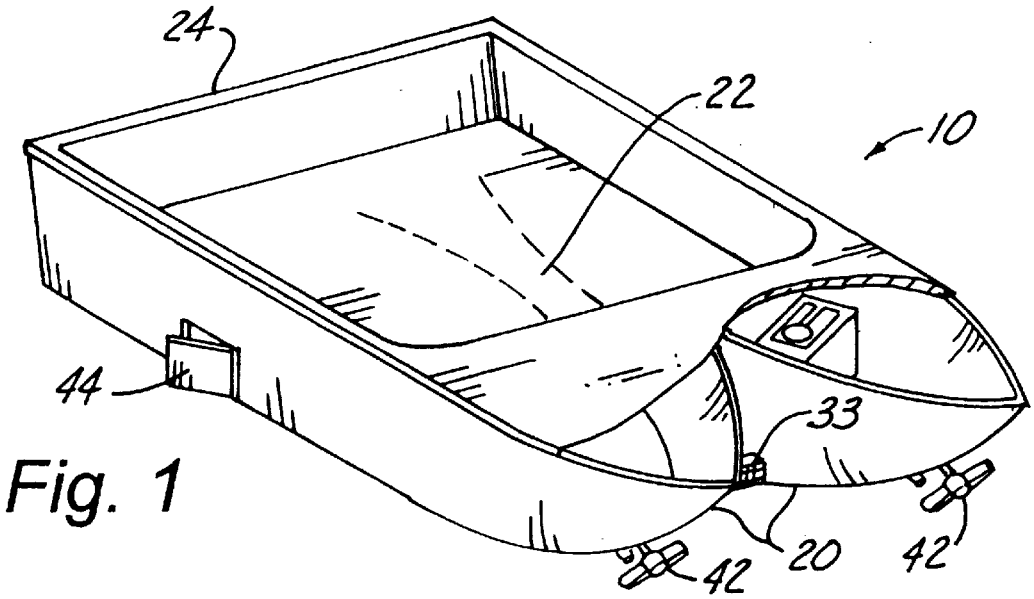
FIG. 1 is a perspective view of a device embodying the concepts of the present invention, with a portion of the top of the hull cut away.
Figure 2:
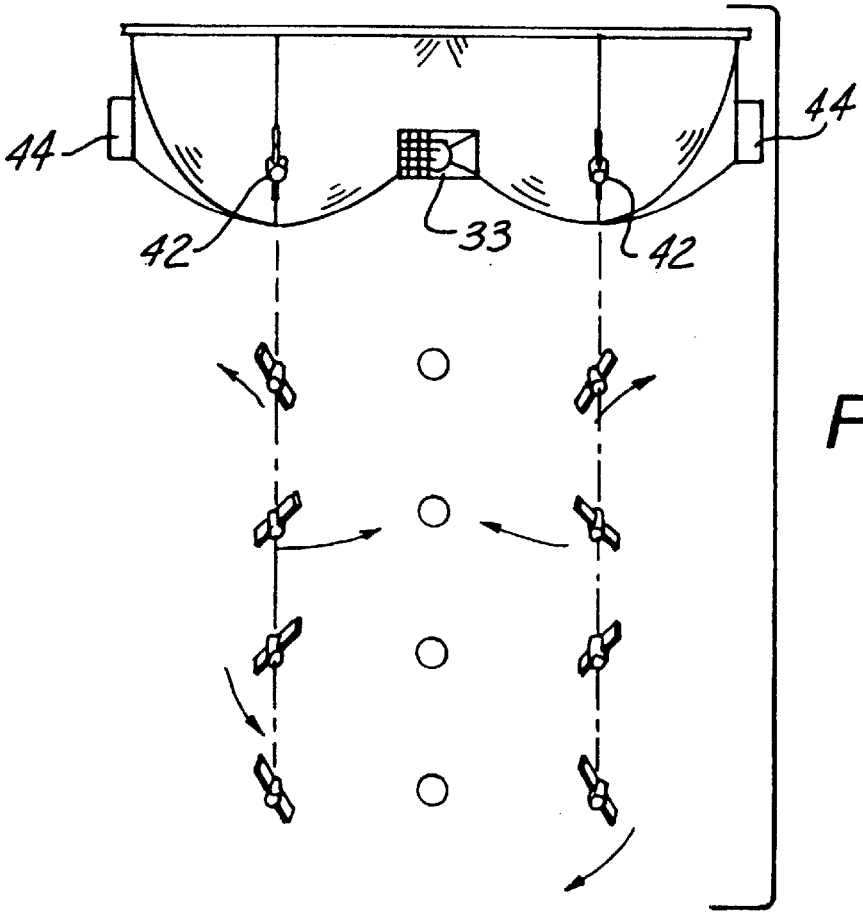
FIG. 2 is a perspective view of the front of the present invention, with diagrams showing operation of baffles.
Figure 3:
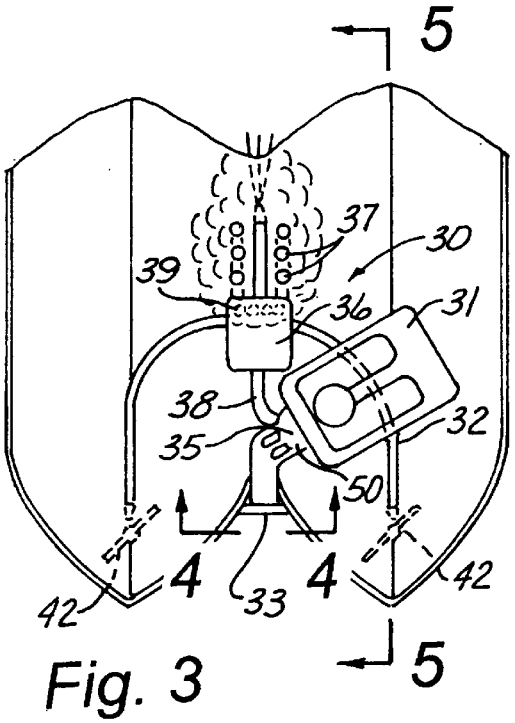
FIG. 3 is a perspective view of the bottom of the present invention, with a portion of the bottom hull cut away to show a waterjet propulsion system.
Figure 6:
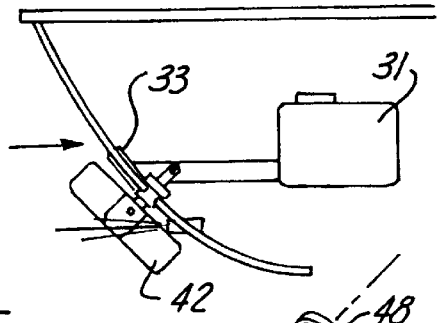
FIG. 6 is a perspective view of the side of the present invention with a portion of the side of the hull cut away to show water flow towards the front of the hull.
Figure 7:
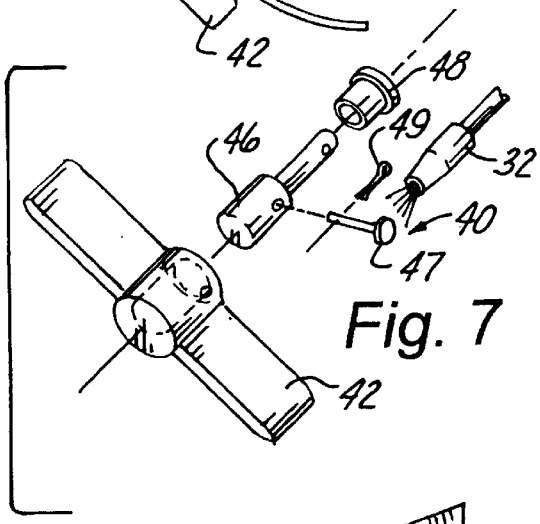
FIG. 7 is a perspective view of the parts of a baffle displayed.
Figure 4:
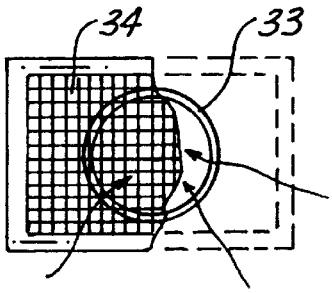
FIG. 4 is a perspective view of a front intake valve for a waterjet system for the present invention.
Figure 8:
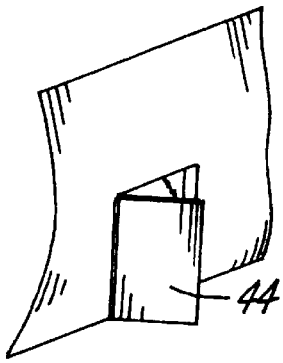
FIG. 8 is a perspective view of a baffle on the side of the vessel in the open position.
Figure 5:
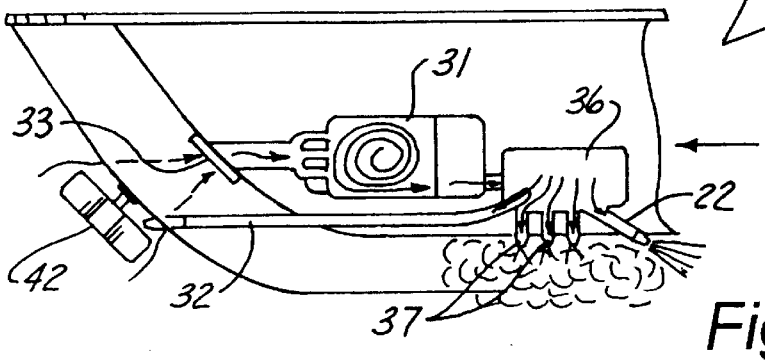
FIG. 5 is a perspective view of the side of the present invention with a portion of the side of the hull cut away to show the operation of a waterjet system.

As can be seen by reference to the drawings, and particular to FIG. 1, the water vessel utilizing waterjet propulsion and hull shape to create water hump lift whereby the bottom of the vessel's hull rises toward the stern that forms the basis of the present invention is designated generally by the reference number 10. A water vessel 10 embodying the present invention is composed of a double bow 20 with a grove in the hull 22, a waterjet system 30 (FIG. 3), and baffles 40 (FIG. 7).

As shown in FIG. 1, the bow of the vessel 20 preferably is a double bow, and the hull of the vessel preferably contains a central dome-like groove 22, that extends upwardly between the bow 20 and the stern 24 of the vessel 10. The vessel 10 preferably contains a baffle 42 positioned in front of each branch of the bow 20. Preferably, the forward baffles 42 are attached to the vessel 10 by a pin 46, and the pin 46 is preferably secured to the vessel 10 with a locking nut 48. The vane 45 of the forward baffle 42 preferably interlocks securely to the pin 46 by a lock pin 47 with its securing clip 49.

The waterjet system 30 preferably includes forward nozzles 32, a water intake opening 33, a water pump 35, a pressure chamber 36, and exit jet nozzles 37. Preferably, the forward nozzles 32 are disposed on the bow 20 of the vessel 10 adjacent to the bow baffles 42. The forward nozzles 32 are preferably reverse jets and are connected to the pressure chamber 36. The water intake opening 33 is preferably disposed centrally between the branches of the bow 20. The water intake opening 33 preferably contains a grid 34 securely disposed as a cover over the opening 33. The water pump 35 is preferably centrally located with the hull of the vessel 10 posterior to the water intake opening 33. Pipes 38 are preferably disposed between the pump 35 and the pressure chamber 36. The pressure chamber 36 is preferably located centrally within the hull of the vessel 10. The exit jet nozzles 37 are preferably disposed posterior to the pressure chamber 36, with the exit jet nozzles 37 extending downwardly at various angles or straight down. The exit jet nozzles 37 preferably are disposed within the central groove 22 within the hull.

In use, water enters the intake opening 33 in the hull of the vessel 10. The intake opening 33 is covered by a grid 34 to keep sticks and large stones from entering the opening 33. Water is then piped without the use of valves to the pump 35. The pump 35 is preferably a centrifugal pump 35. Water preferably goes into the center of the pump 35, and the water is preferably directed to the periphery of the pump 35, where the water exits the pump 35. A clutch 50 is preferably required to disengage the pump 35 motor when starting the motor 31. Water is pumped to the pressure chamber 36, which is a tank.

Preferably, multiple variable flow valves 39 are disposed on the tank 36 wall. The variable flow valves 39 are preferably variable from fully closed to fully open. From the pressure chamber 36, the water is dispensed through the variable flow valves 39, then to exit jet nozzles 37. Preferably, the forward nozzles 32 are aligned with the long axis of the boat 10. The exit jet nozzles 37 are preferably fixed at various exit angles, and blended together in operation to form a composite push for the most economical level of glide travel. The blended amount of various fixed angle jet streams determines where a hump of water will be under the boat 10. The depth, volume, and push of the blended jet streams will depend on the speed of the pump 35.

Baffles 42 positioned at the front of the water vessel 10 preferably direct water away from the vessel 10, or towards the vessel 10, as needed to further the efficiency of the system 10. If the pump 35 has insufficient water flow, the baffles 42 will direct water towards the pump intake area 33. Conversely, if the pump 35 is receiving too much water volume, the baffles 42 will direct water flow away from the pump 35. The baffles 42 also are preferably used for further reducing the volume of water that the vessel 10 is required to displace in traversing through the water. In addition, the bow baffles 42 preferably help to steer the vessel.

Figure 9:
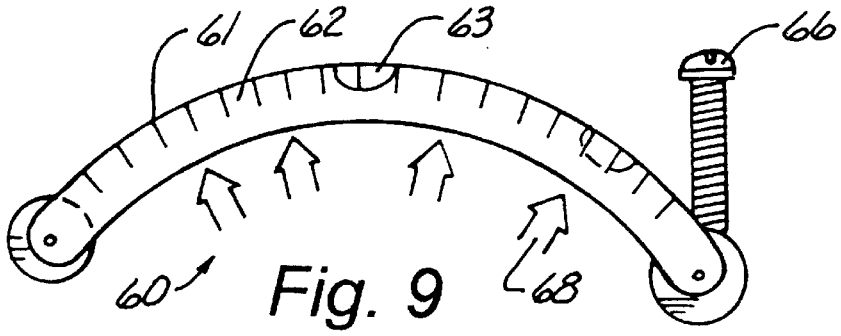
FIG. 9 is a side elevational view of a tilt level gauge for the present invention.

In FIG. 9, an embodiment of the present invention contains a tilt level gauge 60 which is mounted on the vessel 10. The gauge 60 contains a clear curved tube 61 containing liquid 62 and an air bubble 63 for gauging the fore and aft tilt of the boat. The gauge 60 has a hinge 64 at one end and a height adjusting mechanism 66 at the other end. Movable pointers 68 indicate, for example, the level point at dockside when the vessel is unloaded, the tilt at dockside with the vessel loaded, and the low, high, and estimated average tilt when traveling in rough water.

Figure 10:
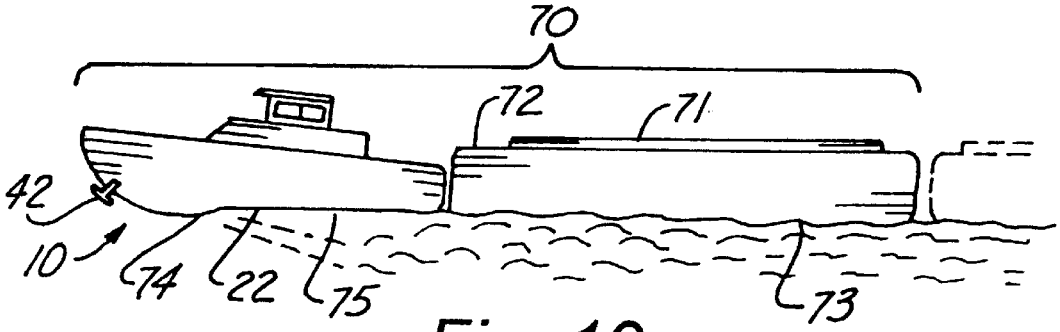
FIG. 10 is a side elevational view of the present invention pulling a barge.
Figure 11:
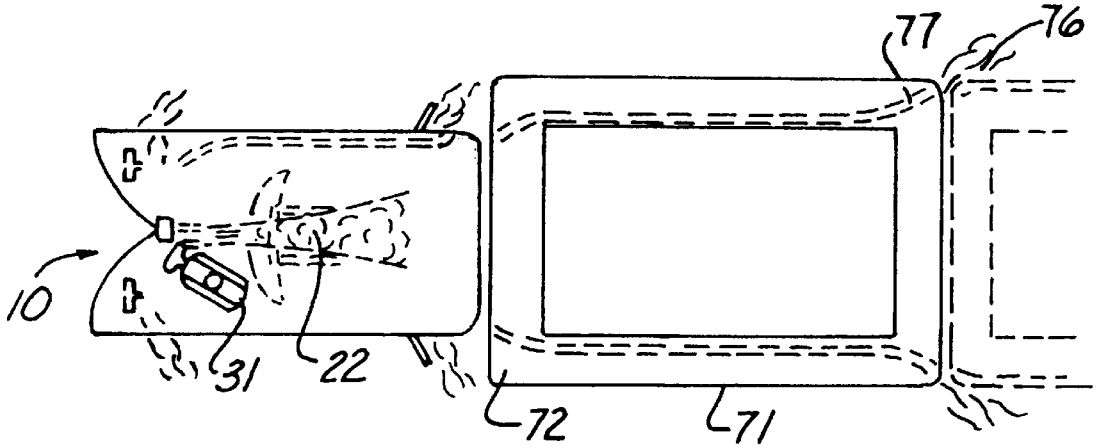
FIG. 11 is a plan view of the present invention pulling a barge.

FIGS. 10 and 11 shows the present invention 10 pulling a barge 71. The vessel 10 pulls the barge bow 72 down so as to tilt the barge bottom 73 into bow down, stern high position. A power jet 74 is angled to thrust the rising water hump 75 under the boatbarge combination 70, making the whole unit slide forward. High pressure water hoses 77 strung to the back of the barges 71 and connected to directional down spout pipes 76 help with the steering of the hump boat barge unit 70. The barge 71 has a concave bottom 73 to help contain the rising water hump 75 that the vessel 10 slides off of.

Figure 12:
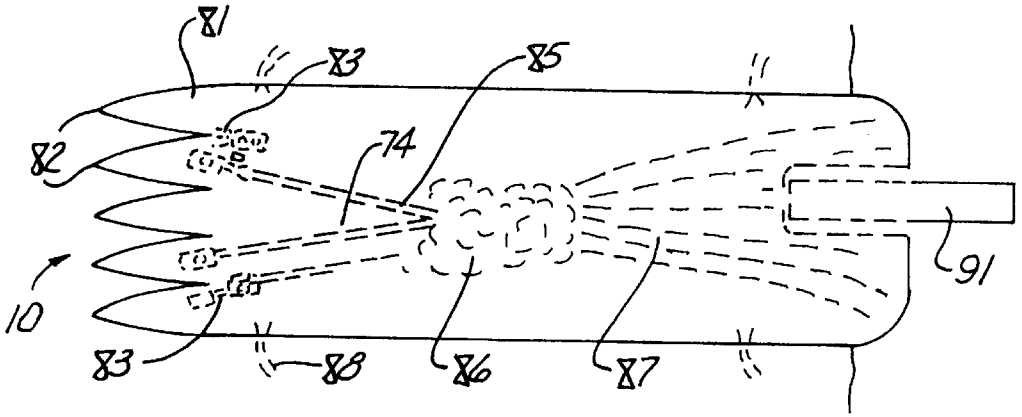
FIG. 12 is a plan view of a cargo-carrying version of the present invention, with the portion underneath the deck exposed.
Figure 13:
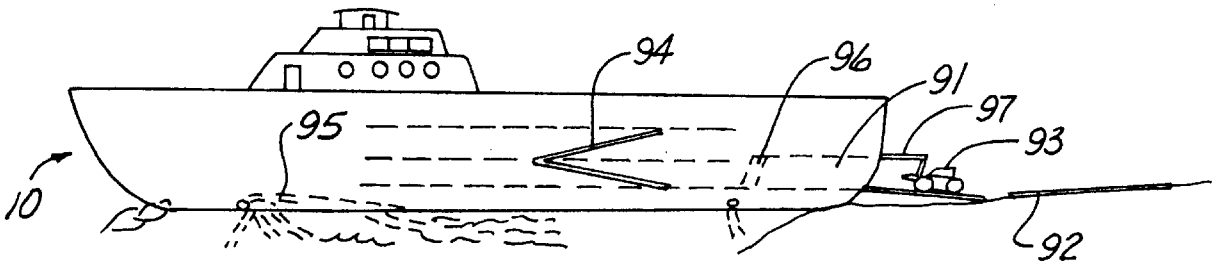
FIG. 13 is a side elevational view of a cargo-carrying version of the present invention.
Figure 14:
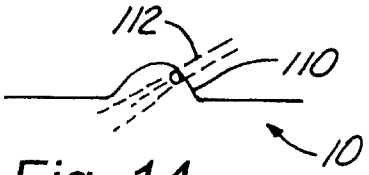
FIG. 14 is an elevational view of a groove in the hull of the present invention for the protection of jet nozzles.

In FIGS. 12, 13, and 14 a cargo-carrying embodiment of the present invention is displayed. In FIG. 12, the bow 81 is shown with a plurality of branches 82, with a pump 83 at each juncture between bow branches 82. The pumps 83 converge their jet streams 84 into the groove 85 to form a common hump of water 86, with glide water 87 behind the hump 86, resulting from the vessel 10 gliding over the hump of water 86. A jet 88 from the side of the vessel 10 is shown for steering the vessel 10. In FIG. 13, a ramp 91 is shown at the rear end of the vessel 10 onto a beach 92 for removal of cargo, and a forklift 93 is shown leaving the vessel 10. Internal ramps 94 inside the vessel 10 are shown. The groove 95 underneath the vessel 10 is visible. A water sealed door 96 and a door flap 97 accommodate the ramp 91. In FIG. 14, a groove 110 is shown in the vessel 10 for protecting the jet nozzles 112.

Figure 15:
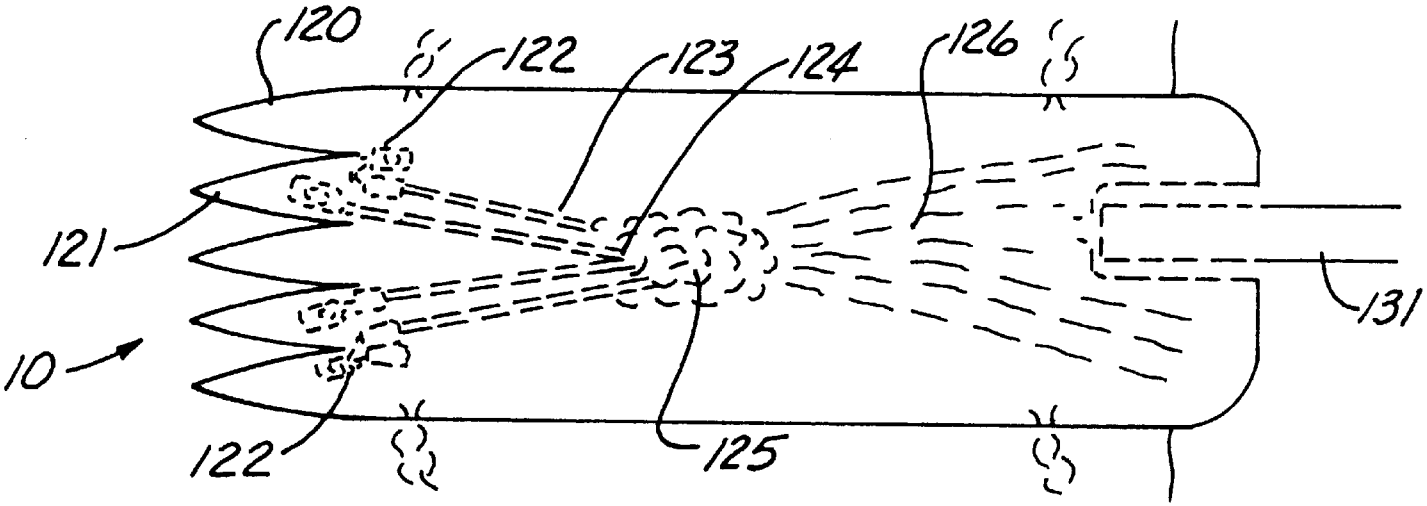
FIG. 15 is a plan view of a passenger-carrying version of the present invention, with the portion underneath the deck exposed.
Figure 16:
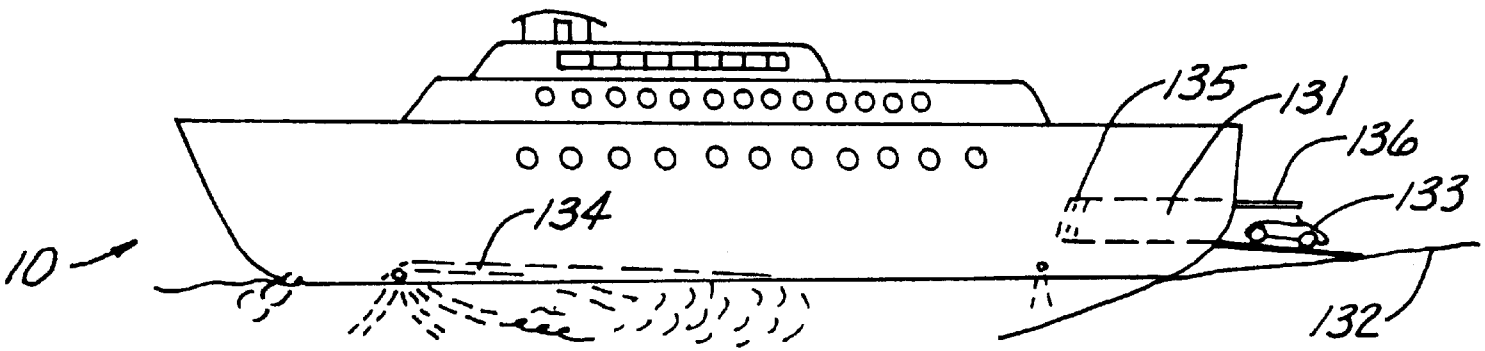
FIG. 16 is a side elevational view of a passenger-carrying version of the present invention.

In FIGS. 15, 16 a passenger-carrying embodiment of the present invention is displayed. In FIG. 15, the bow 120 is shown with a plurality of branches 121, with a pump 122 at each juncture between bow branches 121. The pumps 122 converge their jet streams 123 into the groove 124 to form a common hump of water 125, with glide water 126 behind the hump 125, resulting from the vessel 10 gliding over the hump of water 125. In FIG. 16, a ramp 131 is shown at the rear end of the vessel 10 onto a beach 132 for removal of passengers and cargo, and a passenger vehicle 133 is shown leaving the vessel 10. The groove 134 underneath the vessel 10 is visible. A water sealed door 135 and a door flap 136 accommodate the ramp 131.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

What is claimed is:

1. A water vessel, comprising:

a hull disposed with a central dome hump groove extending fore to aft on the underside of said vessel, said dome hump groove widening as it extends from fore to aft;

a water intake opening disposed at the center of the bow of said vessel;

reverse jet nozzles disposed on the bow of said vessel, and aligned with the long axis of said vessel;

a water pump disposed posterior to said water intake opening;

a pressure chamber connectably disposed to the water pump and the reverse jet nozzles;

output water jet nozzles connectably disposed to said pressure chamber and extending downwardly at a plurality of angles into said central dome hump groove; and baffles for directing water surrounding said vessel, connectably disposed to the bow and the sides of said vessel.

2. The water vessel of claim 1, wherein the bow of said vessel contains a plurality of branches.

3. The water vessel of claim 1, wherein said side baffles are comprised of panels which open and close outwardly from the side of said vessel.

4. The water vessel of claim 1, wherein the bow of said water vessel contains greater than tow branches, said vessel contains a plurality of grooves in its hull to protect said jet nozzles, said vessel contains an inner chamber with ramps for storage, and a water sealable door on the stern of said vessel, wherein said water sealable door is operably disposed as a ramp for emptying said chamber in said vessel.

5. The water vessel of claim 1, wherein said water intake opening contains a grid cover for preventing debris from entering said water intake opening.

6. The water vessel of claim 1, wherein variable rate flow valves are disposed on said pressure chamber.

7. The water vessel of claim 1, wherein a water pump motor is coupled to said water pump, and a clutch coupled to said motor disengages the pump when starting said motor.

8. The water vessel of claim 1, wherein said dome hump groove rises toward the water vessel stern.

9. A water vessel, comprising:

a hull disposed with a dome hump or central groove on the underside of said vessel;

a water intake opening disposed at the center of the bow of said vessel;

reverse jet nozzles disposed on the bow of said vessel, and aligned with the long axis of said vessel;

a water pump disposed posterior to said water intake opening;

a pressure chamber connectably disposed to the water pump and the reverse jet nozzles;

output water jet nozzles connectably disposed to said pressure chamber and extending downwardly at a plurality of angles into said central groove; and baffles for directing water surrounding said vessel, connectably disposed to the bow and the sides of said vessel, wherein said bow baffles are comprised of adjustable vanes for directing the flow of water;

a connecting pin for connecting said vane to said vessel;

a locking nut for securing said connecting pin to said vessel;

a lock pin for securing said vane to said pin; and a clip for securing said lock pin to said vane.

10. A water vessel, comprising:

a hull disposed with a dome hump or central groove on the underside of said vessel;

a water intake opening disposed at the center of the bow of said vessel;

reverse jet nozzles disposed on the bow of said vessel, and aligned with the long axis of said vessel;

a water pump disposed posterior to said water intake opening;

a pressure chamber connectably disposed to the water pump and the reverse jet nozzles;

output waterjet nozzles connectably disposed to said pressure chamber and extending downwardly at a plurality of angles into said central groove;

baffles for directing water surrounding said vessel, connectably disposed to the bow and the sides of said vessel; and a clear curved tube containing liquid and an air bubble for gauging tilt, having a hinge on one end and a height adjusting mechanism at the other end, and having movable pointers to indicate tilt, is disposed on said water vessel.

* * * * *